US009548563B1

(12) United States Patent
Vazquez

(10) Patent No.: US 9,548,563 B1
(45) Date of Patent: Jan. 17, 2017

(54) FINGER LOOP FOR DETACHING A CHARGING CABLE FROM AN ELECTRONIC DEVICE

(71) Applicant: Miguel Vazquez, Carolina, PR (US)

(72) Inventor: Miguel Vazquez, Carolina, PR (US)

( * ) Notice: Subject to any disclaimer, the term of this patent is extended or adjusted under 35 U.S.C. 154(b) by 0 days.

(21) Appl. No.: 14/842,204

(22) Filed: Sep. 1, 2015

(51) Int. Cl.
*H01R 13/633* (2006.01)

(52) U.S. Cl.
CPC ..... *H01R 13/6335* (2013.01)

(58) Field of Classification Search
CPC ..... H01R 13/6335
USPC ..... 439/484
See application file for complete search history.

(56) References Cited

U.S. PATENT DOCUMENTS 3,160,947 A * 12/1964 Sunderlin ..... H01R 13/6335 16/426
4,881,911 A * 11/1989 Haddock ..... H01R 13/6335 439/484
4,927,376 A * 5/1990 Dickie ..... H01R 24/28 439/484
6,733,323 B2 5/2004 Tso-Chin
D491,531 S 6/2004 Lee
6,807,712 B2 * 10/2004 Maatta ..... G06F 1/1616 16/331
6,808,410 B1 10/2004 Lee
7,556,524 B2 7/2009 Kuo
7,946,880 B2 * 5/2011 Tsai ..... H01R 13/506 439/358
8,444,430 B2 * 5/2013 Kappla ..... H01R 13/6275 439/352
8,986,036 B2 * 3/2015 Lindkamp ..... G02B 6/4246 439/160
2004/0048506 A1 3/2004 Chung
2009/0117776 A1 * 5/2009 Kuo ..... H01R 13/6335 439/484
2010/0257697 A1 * 10/2010 Ramsauer ..... E05B 1/0015 16/110.1
2015/0258675 A1 * 9/2015 Laybourne ..... A46B 5/02 345/179

FOREIGN PATENT DOCUMENTS

GB 2215145 A * 9/1989 ..... H01R 13/6335
GB 2227132 A * 7/1990 ..... H01R 13/6335
WO WO2013082204 6/2013

* cited by examiner

*Primary Examiner* — Abdullah Riyami
*Assistant Examiner* — Nelson R Burgos-Guntin
(74) *Attorney, Agent, or Firm* — Kyle A. Fletcher, Esq.

(57) ABSTRACT

The finger loop for detaching a charging cable from an electronic device is a device that is attached to the plug of a cable that forms a loop. The loop is used as a grip that the user can use to withdraw the plug from the port it is plugged into. The finger loop for detaching a charging cable from an electronic device is attached to the plug of a cable using an adhesive. The finger loop for detaching a charging cable from an electronic device comprises an elastic tab, a third adhesive, and a fourth adhesive.

15 Claims, 3 Drawing Sheets

FINGER LOOP FOR DETACHING A CHARGING CABLE FROM AN ELECTRONIC DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of cable and cord guides, more specifically, a cable guide configured for us in disconnecting cables.

SUMMARY OF INVENTION

The finger loop for detaching a charging cable from an electronic device is a device that is attached to the plug of a cable that forms a loop. The loop is used as a grip that the user can use to withdraw the plug from the port it is plugged into. The finger loop for detaching a charging cable from an electronic device is attached to the plug of a cable using an adhesive.

These together with additional objects, features and from an electronic device will be readily apparent to those of ordinary skill in the art upon reading the following detailed description of the presently preferred, but nonetheless illustrative, embodiments when taken in conjunction with the accompanying drawings.

In this respect, before explaining the current embodiments of the finger loop for detaching a charging cable from an electronic device in detail, it is to be understood that the finger loop for detaching a charging cable from an electronic device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the finger loop for detaching a charging cable from an electronic device.

It is therefore important that the claims be regarded as including such equivalent construction insofar as they do not depart from the spirit and scope of the finger loop for detaching a charging cable from an electronic device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
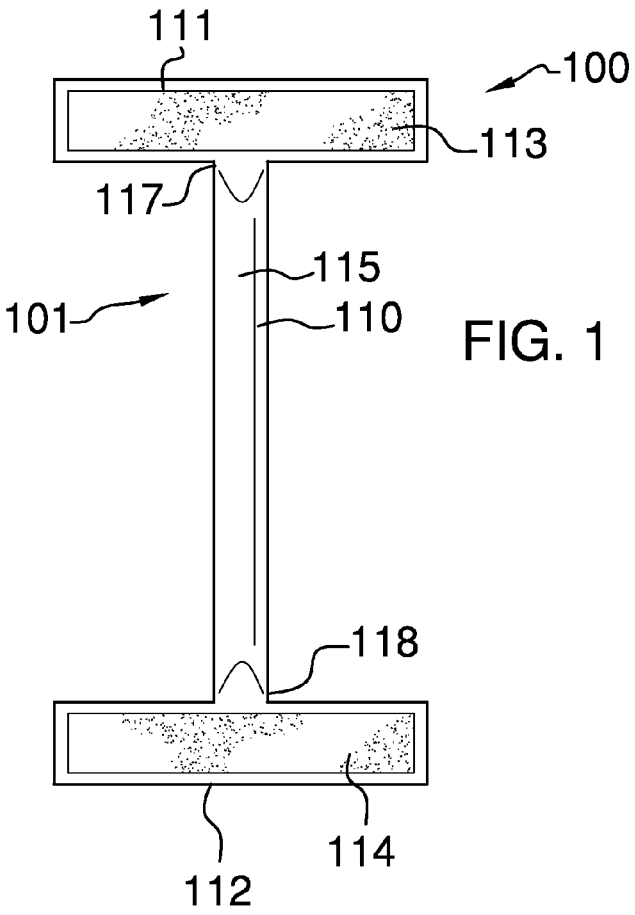
FIG. 1 is a bottom view of an embodiment of the disclosure.
Figure 2:
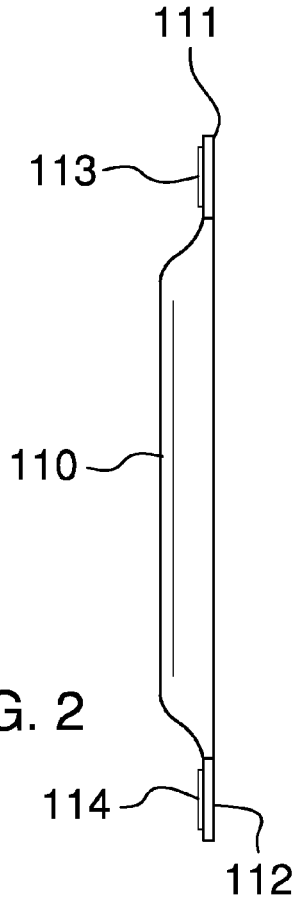
FIG. 2 is a side view of an embodiment of the disclosure.
Figure 3:
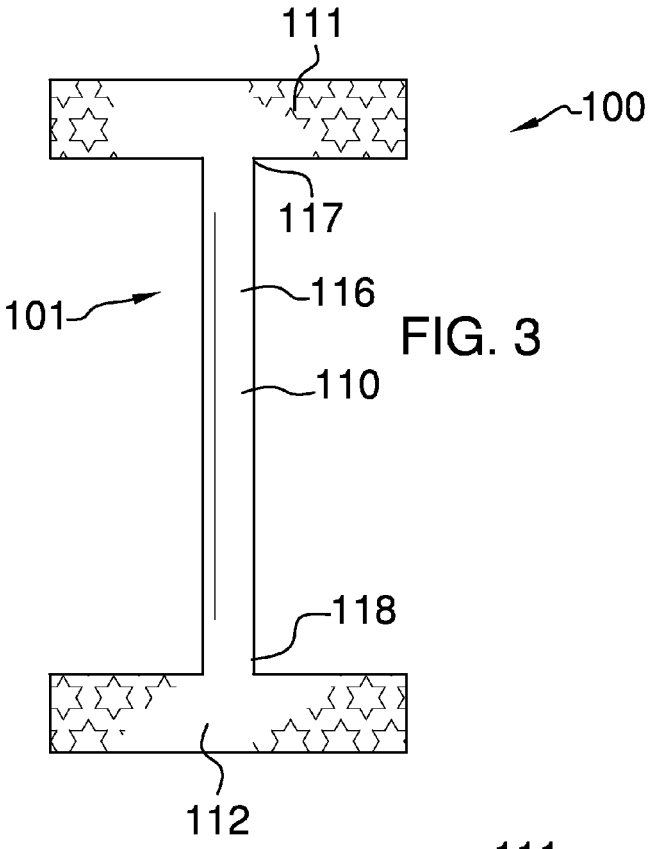
FIG. 3 is a top view of an embodiment of the disclosure.
Figure 4:
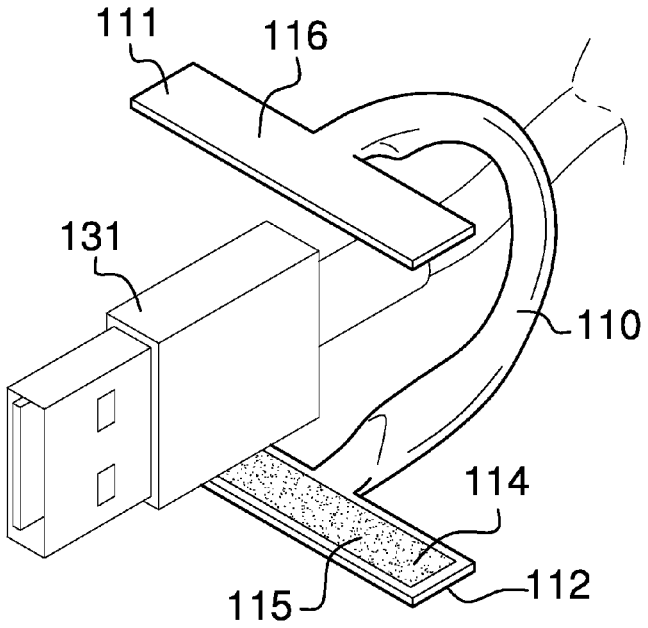
FIG. 4 is an in exploded view of an embodiment of the disclosure.
Figure 5:
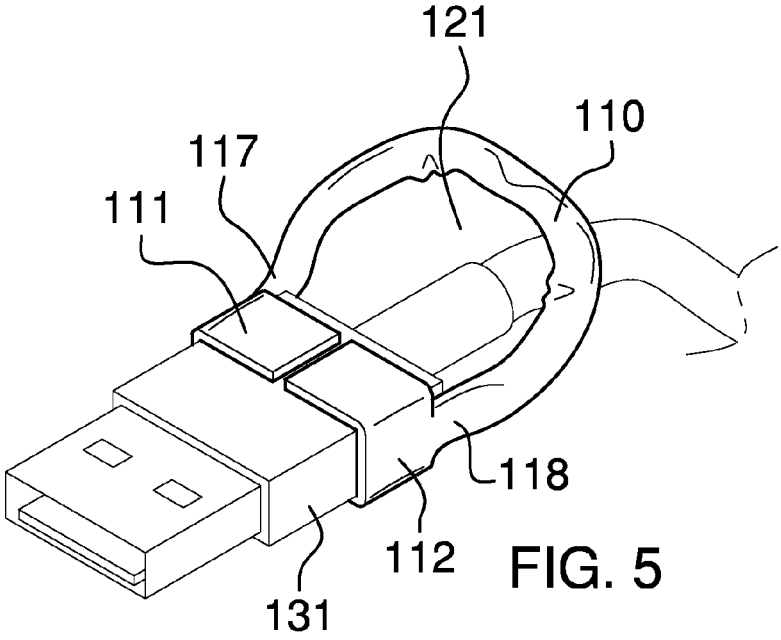
FIG. 5 is an in use view of an embodiment of the disclosure.
Figure 6:
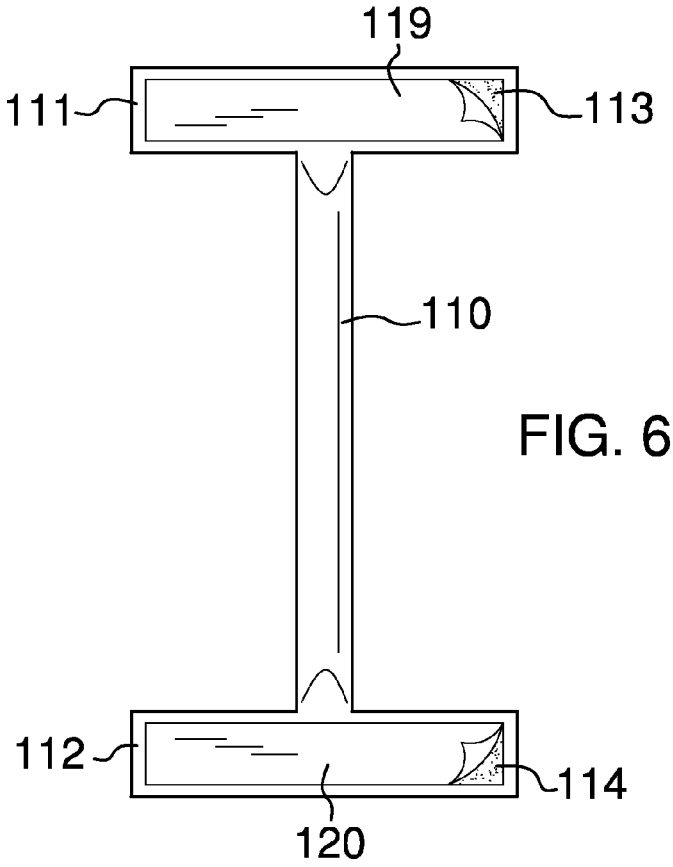
FIG. 6 is another bottom view of an embodiment of the disclosure.

Detailed reference will now be made to a first potential embodiment of the disclosure, which is illustrated in FIGS. 1 through 6. The finger loop for detaching a charging cable from an electronic device 100 (hereinafter invention) comprises an elastic tab 101, a third adhesive 113, and a fourth adhesive 114.

The elastic tab 101 is an object made of an elastic material. The elastic tab 101 further comprises an I strip 110, a first cross strip 111, and a second cross strip 112. The elastic tab 101 is further defined with a fifth side 115 and a sixth side 116. The elastic tab 101 is formed in an I shape wherein the I strip 110 forms the vertical portion of the I and the first cross strip 111 and the second cross strip 112 form the crossbars of the I. Specifically, the first cross strip 111 is placed such that: 1) the center point of the first cross strip 111 is positioned at the seventh end 117 of the I strip 110; and, 2) the direction indicated by the first cross strip 111 runs perpendicular to the direction indicated by the I strip 110. The second cross strip 112 is placed such that: 1) the center point of the second cross strip 112 is positioned at the eighth end 118 of the I strip 110; and, 2) the direction indicated by the second cross strip 112 runs perpendicular to the direction indicated by the I strip 110 and parallel to the direction indicated by the first cross strip 111.

The elastic tab 101 is formed as a single unit. Suitable materials include, but are not limited to, a latex based rubber or a synthetic elastic polymer.

The fifth side 115 of the elastic tab 101 has placed on it a third adhesive 113 and a fourth adhesive 114. The third adhesive 113 is placed on the fifth side 115 of the first cross strip 111. The fourth adhesive 114 is placed on the fifth side 115 of the second cross strip 112. The purpose of the third adhesive 113 and the fourth adhesive 114 is to attach the elastic tab 101 to the cable plug 131. The third adhesive 113 is a pressure sensitive adhesive that forms an adhesive bond between the fifth side 115 of the first cross strip 111 and the cable plug 131 when pressure is applied. The fourth adhesive 114 is a pressure sensitive adhesive that forms an adhesive bond between the fifth side 115 of the second cross strip 112 and the cable plug 131 when pressure is applied.

Suitable pressure sensitive adhesives include, but are not limited to, acrylic based adhesives, natural rubber based adhesives, and butyl rubber based adhesives.

The third adhesive 113 is protected by a ninth paper sheet 119. The purpose of the ninth paper sheet 119 is to prevent the third adhesive 113 from being prematurely or inadvertently adhered to an object. The ninth sheet 119 is a silicone impregnated sheet of paper that is designed not to bond with the third adhesive 113. The fourth adhesive 114 is protected by a tenth paper sheet 120. The purpose of the tenth paper sheet 120 is to prevent the fourth adhesive 114 from being prematurely or inadvertently adhered to an object. The tenth paper sheet 120 is a silicone impregnated sheet of paper that is designed not to bond with the third adhesive 113. The third adhesive 113 is applied to the entire fifth side 115 of the first cross strip 111. The fourth adhesive 114 is applied to the entire fifth side 115 of the second cross strip 112.

To use the invention 100, the ninth paper sheet 119 is removed from the third adhesive 113. The first cross strip 111 is then wrapped around a cable plug 131 and pressure is applied to the first cross strip 111 to activate the third adhesive 113. The tenth paper sheet 120 is removed from the fourth adhesive 114. The second cross strip 112 is then wrapped around a same cable plug 131 that the first cross strip 111 was adhered to. Pressure is applied to the second cross strip 112 to activate the fourth adhesive 114 and bond the second cross strip 112 to the cable plug 131.

When the first cross strip 111 and the second cross strip 112 are adhered to the same cable plug 131, the close proximity of the seventh end 117 and the eighth end 118 causes the I strip 110 to bend and form a finger loop 121. This finger loop 121 acts as a grip that the user can grasp to pull the cable plug 131 out of the port.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Elastic: As used in this disclosure, an elastic is an object that deforms when a force is applied to it and that is able to return to its original shape after the force is removed.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A handle comprising:
an elastic tab, a third adhesive, and a fourth adhesive;
wherein the handle forms a finger loop;
wherein the handle is attached to a cable plug;
wherein the cable plug is attached to a portable electronic device;
wherein the finger loop is used to pull the cable plug out of the port the cable plug is inserted into;
wherein the elastic tab is made of an elastic material;
wherein the elastic tab further comprises an I strip, a first cross strip, and a second cross strip;
wherein the elastic tab is further defined with a fifth side and a sixth side;
wherein the fifth side of the elastic tab has placed on it the third adhesive and the fourth adhesive;
wherein the third adhesive is placed on the fifth side of the first cross strip;
wherein the fourth adhesive is placed on the fifth side of the second cross strip.

2. The handle according to claim 1 wherein the elastic tab is formed in an I shape.

3. The handle according to claim 2 wherein the the I strip forms the vertical portion of the I;
wherein the first cross strip forms the first crossbar of the I;
wherein the second cross strip form the second crossbars of the I.

4. The handle according to claim 3 wherein the first cross strip is placed such that the center point of the first cross strip is positioned at the seventh end of the I strip; and
the direction indicated by the first cross strip runs perpendicular to the direction indicated by the I strip.

5. The handle according to claim 4 wherein the second cross strip is placed such that the center point of the second cross strip is positioned at the eighth end of the I strip;
the direction indicated by the second cross strip runs perpendicular to the direction indicated by the I strip; and
the direction indicated by the second cross strip runs parallel to the direction indicated by the first cross strip.

6. The handle according to claim 5 wherein the third adhesive is used to attach the first cross strip to the cable plug.

7. The handle according to claim 6 wherein the fourth adhesive is used to attach the second cross strip to the cable plug.

8. The handle according to claim 7 wherein a finger loop is formed in the elastic tab.

9. The handle according to claim 8 wherein the third adhesive is a pressure sensitive adhesive;
wherein the fourth adhesive is a pressure sensitive adhesive.

10. The handle according to claim 9 wherein the third adhesive is protected by a ninth paper sheet;
wherein the fourth adhesive is protected by a tenth paper sheet.

11. The handle according to claim 1 wherein
the elastic tab further comprises an I strip;
wherein the elastic tab is attached to a first cable plug;
wherein when the elastic tab is attached to the first cable plug the I strip forms the finger loop;
wherein the finger loop is pulled to remove the cable plug from the port the cable plug is inserted into.

12. The handle according to claim 11 wherein wherein the first cross strip is attached to the first cable plug;

wherein the second cross strip is attached to the first cable plug;

wherein the close proximity of the first cross strip and the second cross strip causes the I strip to bend and form the finger loop.

13. The handle according to claim 12 wherein wherein the first cross strip is attached to the first cable plug using the third adhesive;

wherein the second cross strip is attached to the first cable plug using the fourth adhesive.

14. The handle according to claim 13 wherein the third adhesive is a pressure sensitive adhesive;

wherein the fourth adhesive is a pressure sensitive adhesive.

15. The handle according to claim 14 wherein the third adhesive is protected by a ninth paper sheet;

wherein the fourth adhesive is protected by a tenth paper sheet.

* * * * *